US005553441A

United States Patent [19]

Ivansco, Jr. et al.

[11] Patent Number: 5,553,441

[45] Date of Patent: Sep. 10, 1996

[54] CARTON CONVEYOR AND LOADING APPARATUS WITH ADJUSTABLE GUIDE MEMBERS

[75] Inventors: Thomas L. Ivansco, Jr., Hoffman Estates; Robert S. Kilian, Franklin Park, both of Ill.; Phillip M. Elliott, Kenosha, Wis.

[73] Assignee: The Paxall Group, Inc., Skokie, Ill.

[21] Appl. No.: 336,671

[22] Filed: Nov. 7, 1994

[51] Int. Cl.[6] ..... B65B 59/00

[52] U.S. Cl. ..... 53/249; 53/201; 53/257; 198/861.1; 493/479

[58] Field of Search ..... 53/257, 249, 201, 53/491, 377.2, 378.3, 579, 564; 493/479, 478; 198/836.6, 861.1

[56] References Cited

U.S. PATENT DOCUMENTS 2,242,177 5/1941 Ferguson ..... 53/377.2 X
2,324,401 7/1943 Kimball ..... 53/377.2 X
3,325,977 6/1967 Kirsten ..... 53/201 X
4,642,975 2/1987 Langen et al. ..... 53/564
4,718,540 1/1988 Greenwell ..... 198/627
4,880,104 11/1989 Evans et al. ..... 198/836.3 X

*Primary Examiner*—James F. Coan
*Attorney, Agent, or Firm*—David E. Dougherty

[57] ABSTRACT

A vertically oriented horizontally extending carton conveyor and loading apparatus incorporates a mechanical mechanism for simultaneously adjusting the distance between a pair of longitudinally extending guide rails at a plurality of locations. The carton conveyor also includes an intermediate member and a carton finishing apparatus disposed on the intermediate member for closing and sealing operations. The mechanical mechanism simultaneously moves a first of the guide rails and the intermediate member laterally with respect to a second of the guide rails, but with the mounting member being moved one half of the distance of the first guide rail.

9 Claims, 5 Drawing Sheets

CARTON CONVEYOR AND LOADING APPARATUS WITH ADJUSTABLE GUIDE MEMBERS

FIELD OF THE INVENTION

This invention relates to an improved carton conveyor and loading apparatus, and more particularly, to an improved vertically oriented carton conveyor which incorporates a mechanical mechanism for simultaneously adjusting the distance between a pair of longitudinally extending parallel guide members at a plurality of locations.

BACKGROUND FOR THE INVENTION

Cartoning apparatus normally contain a magazine for receiving a supply of flat folded carton blanks and apparatus for ejecting those carton blanks from the magazine and erecting them into a generally rectangular tubular form. The cartoner typically includes a pair of endless chains, one carrying leading transport lugs and the other carrying trailing transport lugs. In such apparatus, a carton is erected and captured between the leading and trailing transport lugs. The carton is then held between these lugs as it passes through a filling station.

As the carton passes through the filling station, a barrel loader thrusts product into the carton, and as it passes through a gluing and flap closing apparatus, the carton is sealed. However, if a carton as it is transported through the sealing stages is not square, the flaps are misaligned on the resulting package making it an unsightly or unacceptable package.

In typical applications, cartoners require frequent changeovers for running different sizes of cartons. In the changeover, mechanics use wrenches to loosen parts, slip the parts relative to one another and re-tighten the parts to fix them in that position. For example, the chain carrying the leading lug is physically shifted with respect to the chain carrying the trailing lugs to accommodate cartons of greater or lesser length. In this case, length refers to the dimension in the direction of machine movement, i.e., the carton width taken across the face or front panel of a carton.

In addition, the cartons used for cereals or the like may vary in front to back depth or thickness and height. Therefore, it is difficult and time consuming to manually adjust the various guide bars in order to accommodate different sizes of cartons. It is difficult because of adjustments for the carton finishing operations, such as flap closing and sealing. The cartons must be properly aligned, the cartons "squared" and brought into register with a filler for the loading operation. It is also difficult because carton conveying and loading apparatus are typically of considerable length, and because there are a large number of steps to be performed at different points along the length of the machine.

The U.S. Pat. No. 4,642,975 of Langen et al. discloses one approach to a carton loading machine which facilitates the adjustment of the machine to accommodate cartons of different sizes. In that machine, retainer bars are arranged along at least three sides of a square configuration of a carton's pathway and are mounted for simultaneous movement with respect to a plurality of receptacles so that the spacing between the retainer bar and the oppositely disposed wall of the receptacle can be adjusted to accommodate articles of different sizes.

It has now been found that a carton conveyor and loading apparatus in accordance with the present invention offers a number of advantages over the prior art. For example, the conveyor in accordance with the present invention includes means for simultaneous lateral adjustment of an outer guide rail along its entire length and of an intermediate member which carries carton finishing apparatus. Such adjustments may be readily accomplished manually or by a programmed computer. For example, a change to accommodate a carton of a specific size can be preprogrammed so that an operator of minimal skill merely indicates a carton number, and the machine will adjust itself to the preprogrammed setting for that carton.

The mechanism disclosed and claimed herein may also incorporate an adjustable pocket mechanism such as those claimed in a copending application of Kraig Klopfenstein Ser. No. 08/335,961, filed on Nov. 7, 1994, entitled "Adjustable Pocket Mechanism" which is assigned to the same assignee as the present invention and which is incorporated herein in its entirety by reference.

Furthermore, it is presently believed that the carton conveyor in accordance with the present invention can be manufactured at a competitive price, will be relatively compact, easily adjustable and operable by a relatively unskilled employee. In addition, such apparatus is believed to be relatively durable and easily serviced.

BRIEF SUMMARY OF THE INVENTION

In essence, the present invention contemplates a carton conveyor and a loading apparatus in which cartons are vertically oriented and upwardly open when loading and in which the cartons are transported from a first location to a second location and back towards a third location. The cartoner includes transport means such as an endless belt or chain which defines an endless pathway or closed loop in a generally horizontal plane. In a preferred embodiment of the invention, the pathway defines a generally rectangular path with a pair of parallel linear portions and with a non-linear or semicircular portion at each end thereof. A plurality of pocket members are attached to the transport means and adapted to receive and/or grip a plurality of cartons therein for movement along the pathway.

The apparatus also includes first and second guide members such as a pair of guide rails for positioning a carton as it is transported along a portion of the pathway. For example, a first and a second horizontal longitudinally extending guide rail guides and/or positions the cartons as they are moved along a linear portion of the pathway. A first of the guide rails is referred to as an inner guide rail and is located inwardly from the second of the guide rails and is fixed with respect to a frame member of the carton conveyor and loading apparatus and with respect to the pathway. The second or outer guide rail is adjustable inwardly or outwardly, i.e., toward or away from the first guide rail in order to accommodate cartons of different thicknesses. In a preferred embodiment of the invention, an inner and outer guide rail extend along each of the linear portions of the pathway.

Adjusting means such as a plurality of worm drives are driven by a common shaft and simultaneously move the outer rails at a plurality of points along their lengths. The invention also incorporates conventional carton finishing apparatus such as flap closers and sealers and an intermediate member for positioning the carton finishing apparatus with respect to the cartons being transported by the endless conveyor. The intermediate member is essentially equally spaced from the first and second guide members so that its position corresponds with the center line of the carton. In a preferred embodiment of the invention, the intermediate member and the second guide member are movable outwardly or inwardly with respect to the first guide member to accommodate cartons of different thicknesses. In this embodiment of the invention, the mechanism for moving the two members is constructed and arranged to move the intermediate member a distance which is equal to one half of the distance that the second guide member is moved so that the intermediate member remains centered.

A plurality of leading and trailing transport lugs are arranged along and connected to the endless conveyor. The transport lugs, i.e., a leading and trailing transport lug, engage a carton on each side thereof and maintain the sides parallel to one another as the carton is moved along the conveyor. The trailing lug also fixes the position of the carton for registration with the carton finishing apparatus.

The invention will now be described in connection with the accompanying drawings wherein like reference numerals have been used to designate like parts.

DESCRIPTION OF THE PREFERRED EMBODIMENTS OF THE INVENTION

A cartoner in accordance with the present invention may include means for positioning and fixing the upper, back and trailing comer of a carton with respect to the pathway so that the upper, back and trailing comer provide a reference point for adjustment with respect to a carton thickness and for positioning the carton for filling and other operations. The mechanism for using an upper, back and trailing comer of a carton for a reference are disclosed and claimed in a copending application of Kraig Klopfenstein, entitled "Carton Conveyor and Loading Apparatus", which was filed on Nov. 7, 1994, Ser. No. 08/335,961, assigned to the same assignee as the present invention and incorporated herein in its entirety by reference.

As used herein, the term "thickness" is the distance between the face of a carton and its rear surface, while "width" or "length" refers to horizontal measurement across the face of the carton. The distance from the bottom of the carton to the top is referred to as the height of the carton.

Figure 1:
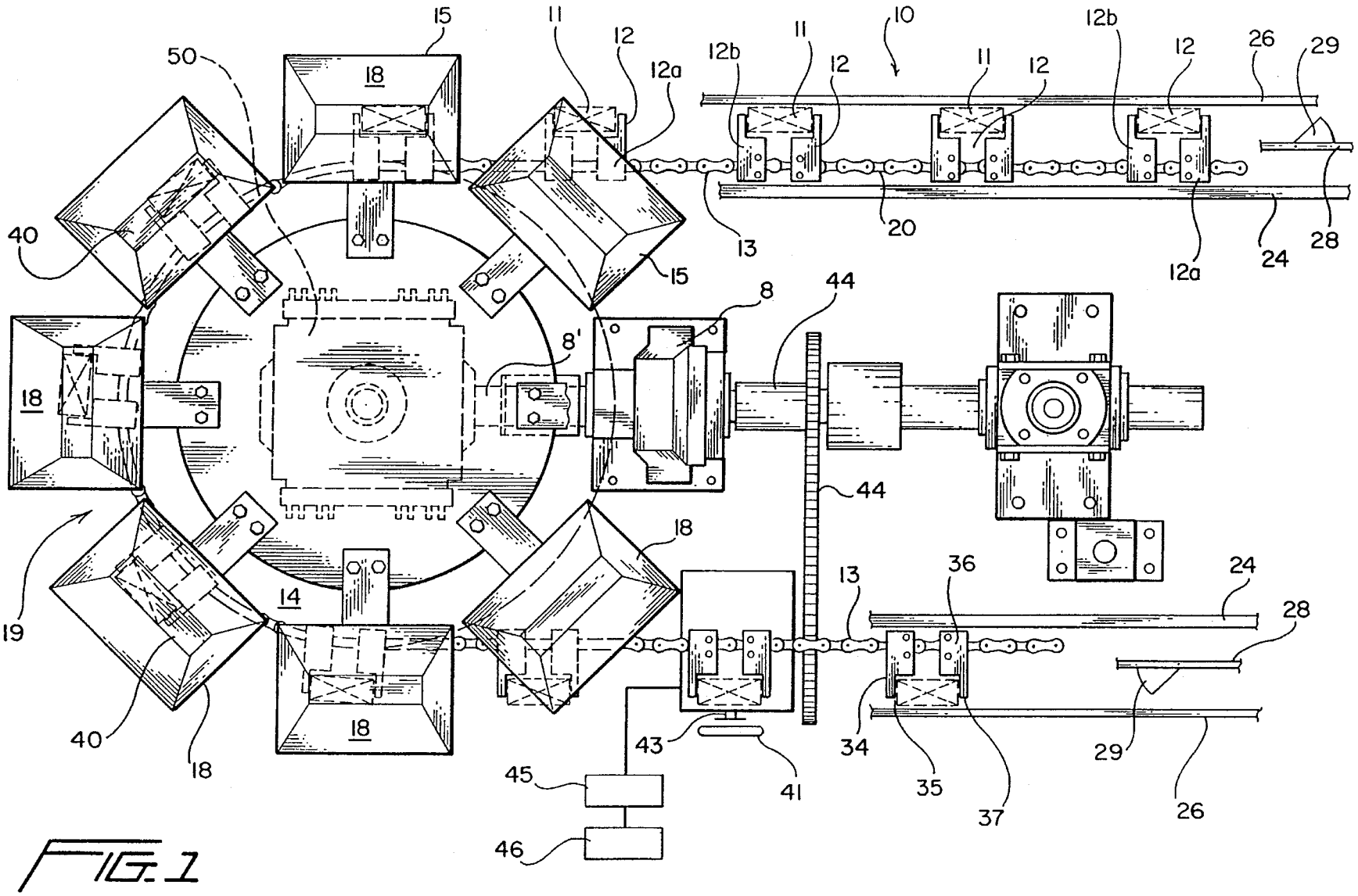
FIG. 1 is a top or plan view which shows a portion of a carton conveyor and loading apparatus in accordance with the invention and which includes a mechanism for positioning and fixing the upper back trailing comer of a carton with respect to an endless pathway.
Figure 2:
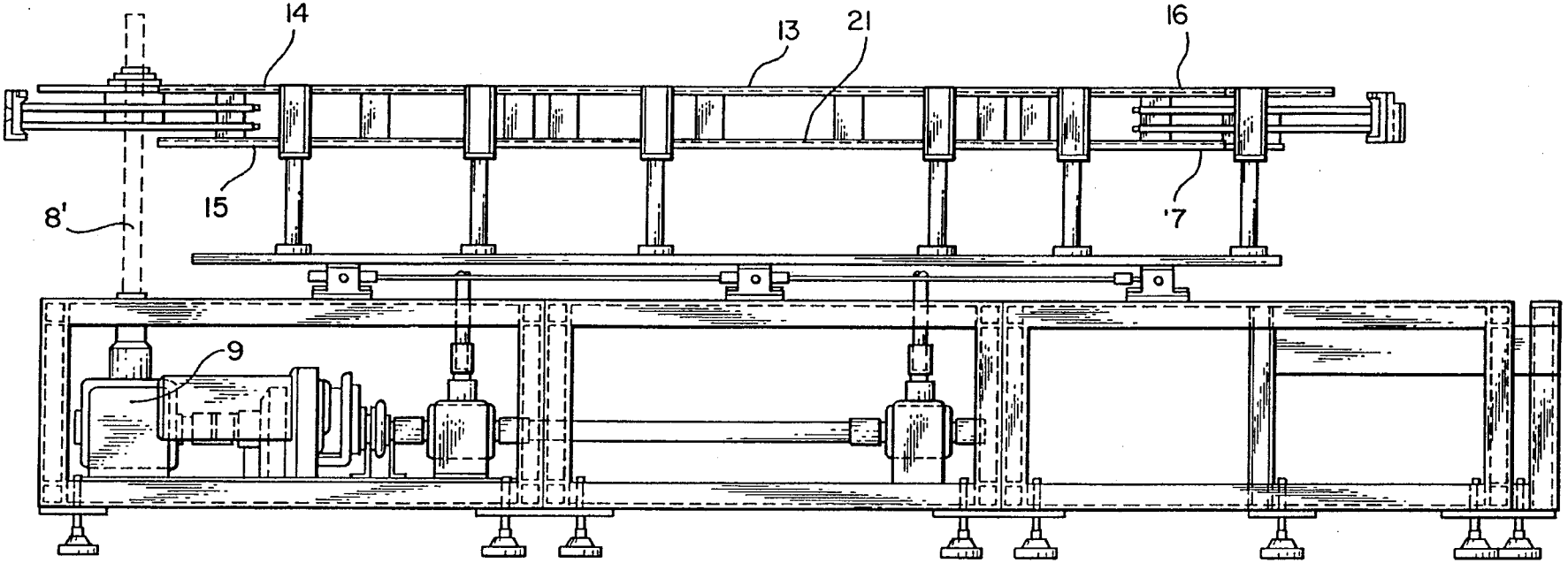
FIG. 2 is a side elevational view of a carton conveyor in accordance with the invention.
Figure 3:
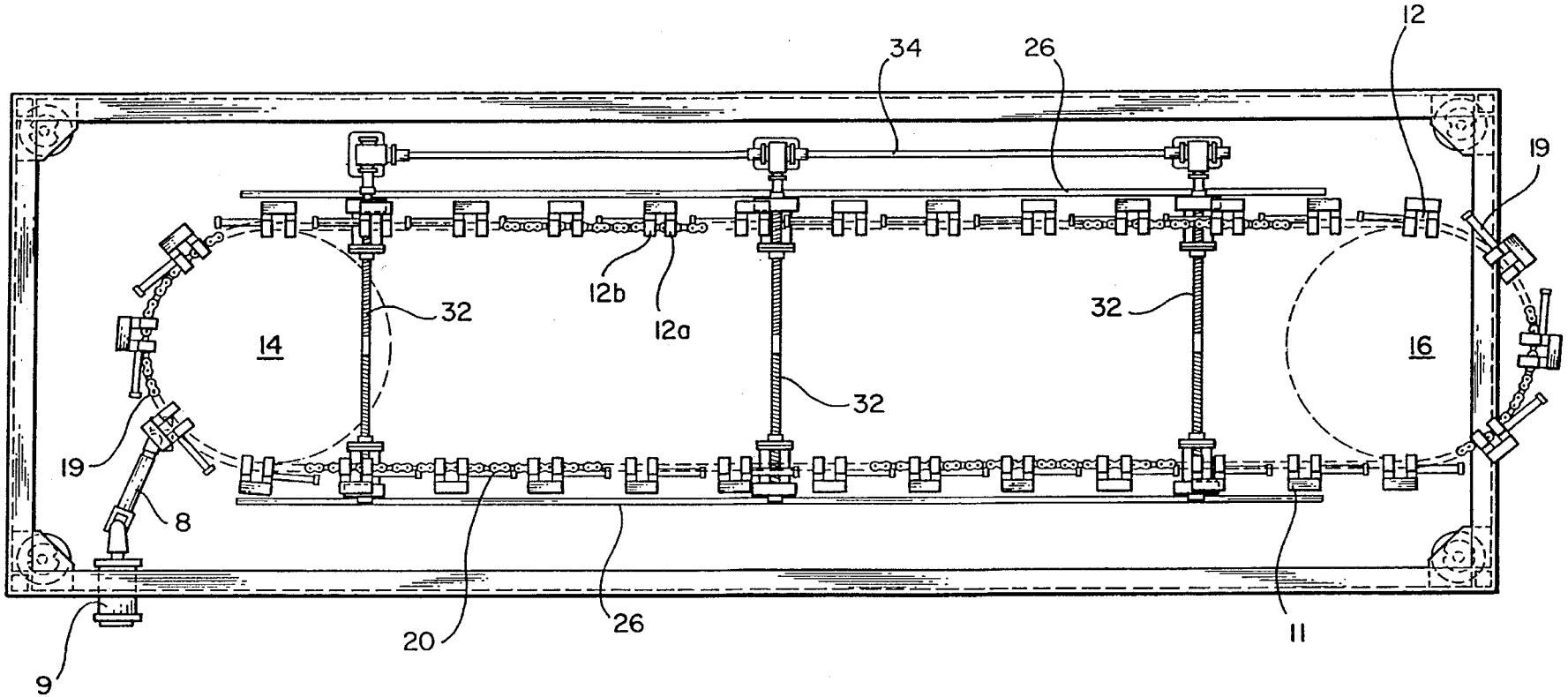
FIG. 3 is a top or plan view of the carton conveyor shown in FIG. 2.

As shown in FIGS. 1–3, a carton conveyor and loading apparatus 10 includes a plurality of adjustable pocket members 12 which are adapted to receive a generally rectangular carton 11 therein. The apparatus 10 transports a carton 11 along a non-linear endless pathway as it is carded through its filling and sealing operation. For example, a plurality of cartons 11 are shown as they travel along a linear path, around a semicircular pathway defined by a pair of a parallel sprockets 14 and 15 (sprocket 15 is shown below sprocket 14 in FIG. 2). A second pair of sprockets 16 and 17 (shown in FIG. 2) lie in the same planes as sprockets 14 and 15 to complete a generally rectangular pathway with semi-circular ends.

As the cartons 11 are transported to a curved portion of the pathway, they are brought into register with a plurality of fillers, such as, hoppers or spouts 18. A plurality of spouts 18 are mounted on sprocket 14 or an extension thereof and rotated thereby so that they are brought into register with the canons 11, as the canons 11 follow a semicircular pathway around sprocket 14. It is important that the canons are maintained square and are in alignment with a spout 18. If not, a portion of the charge would be dumped on the outside of the canon which would result in partial filling while a portion of the charge fell onto the floor or into the machine. The mechanism for maintaining the adjustable pocket square while moving about a sprocket are described and claimed in the aforementioned copending application for an "Adjustable Pocket Mechanism".

Means, such as an endless chain 13, define a pathway for moving the plurality of cartons 11 therealong. The pathway follows a generally rectangular longitudinally extending configuration with a pair of non-linear or circular end portions 19. A first longitudinally extending horizontally disposed guide rail or rod 24 of any desired cross-sectional configuration is fixed to a frame member of the cartoner 10. The rod positions a rear portion of the adjustable pockets 12 to thereby establish a reference point which lies in a plane of the back surface of a carton 14.

The chain 13 moves the adjustable pocket 12 from a first station or pick-up point along a straight line, around sprocket 14 and back along a straight line toward a second sprocket 16 (shown in FIG. 3) and to a discharge station. A second longitudinally extending horizontally disposed guide rail 26 is adjustably mounted to move inwardly or outwardly with respect to rod 24 (see FIG. 4) in order to accommodate cartons of a different thickness.

The apparatus 10 also includes an intermediate member such as a rod or rail 28 which is disposed between rod 24 and guide member 26. This member or rail 28 has carton finishing apparatus 29 such as flap tuckers and sealers disposed thereon. Carton finishing apparatus 29 may, for example, include all of the center line tools such as trailing flap tuckers, glue heads, V-ploughs (flaring), side flap closing ploughs, etc. which are mounted on and adjustable with the intermediate member or center rail 28. Top and bottom track rails may also be positioned horizontally by the center line rails as will be described hereinafter.

Means such as a screw drive mechanism 32 (see FIG. 3) are constructed and arranged to adjust the guide rails 26 inwardly and outwardly from a plurality of points with respect to the rod 24. For example, a screw drive mechanism 32 may comprise a plurality of screw or worm drives which are simultaneously driven by a common drive shaft 34 so that the guide rails 26 are moved inwardly and outwardly with respect to rod 24 along their entire length.

Figure 4:
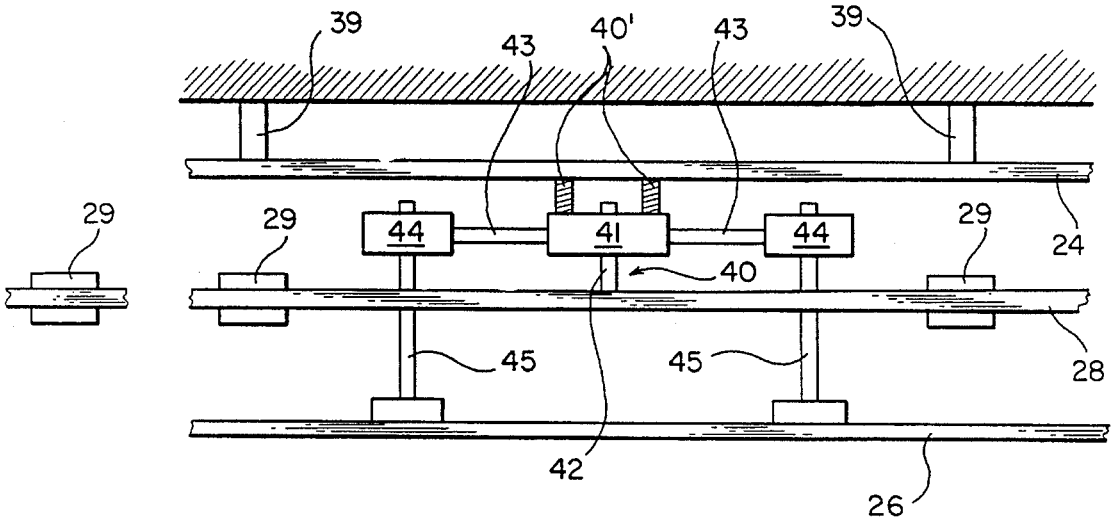
FIG. 4 is a schematic illustration of the carton positioning and adjustment means.

In a preferred embodiment of the invention, means such as second drive mechanism 40 (see FIG. 4) which includes a gear box 41 and screw drive 42 are fixed with respect to guide rail 24 by mounting lugs 40 and move the intermediate member 28 inwardly and outwardly with respect to the rod 24. As illustrated in FIG. 4, the inner rail 24 is fixed to a frame of a cartoner by means of mounting members 39. In the preferred embodiment of the invention, the drive mechanism 40 also moves the guide rail 26 inwardly and outwardly simultaneously with any movement of the intermediate member 28. However, the distance which guide rail 26 is moved is preferably twice that of the distance moved by the intermediate member 28. This relative movement of intermediate member 28 and guide rail 26 is accomplished by the selection of gearing or other means as will be well understood by those skilled in the art. The movement of the guide rail 26 is accomplished by means of the shafts 43, gear boxes 44 and worm drives 45.

The position of cartons 11 with respect to a vertical axis is accomplished by an adjustable rail 60 (see FIG. 5) which may be moved up or down and fixed in a preselected position by any suitable means. The rod 60 may, for example, be moved to accommodate cartons of different heights and will be adjusted so that the top of the carton 11 is flush with the top of the adjustable pocket mechanism 13 or other suitable reference which fixes the top plane of the carton as a reference for any adjustments.

Figure 5:
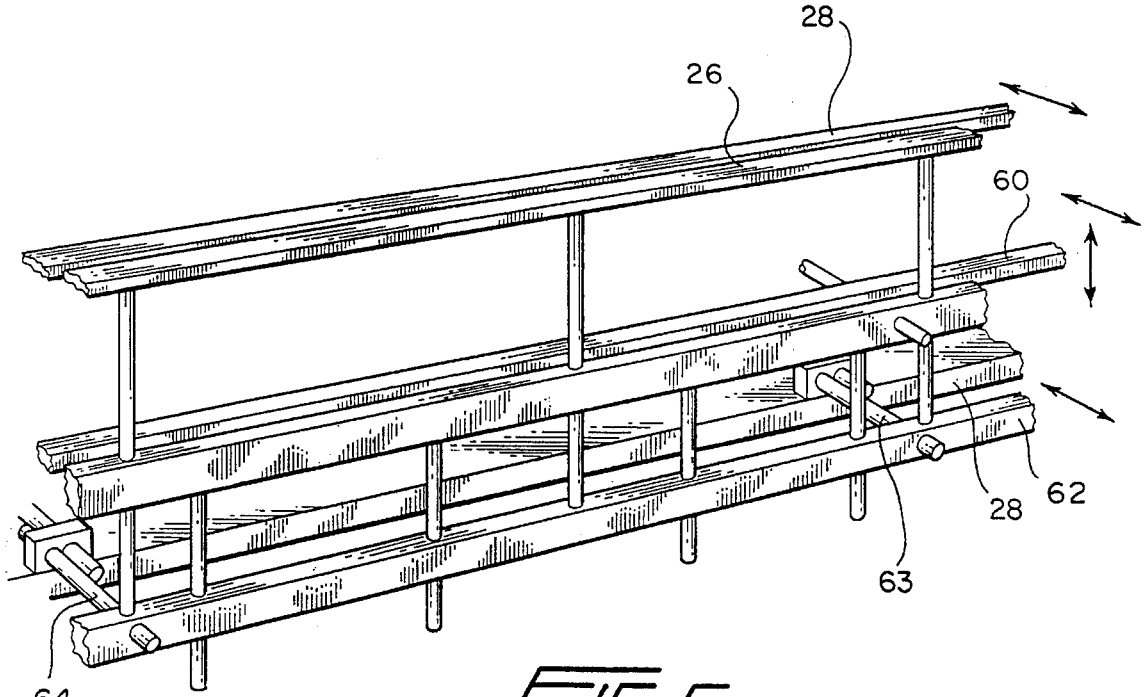
FIG. 5 is a perspective view of a plurality of rails for positioning a carton and for accommodating cartons of different sizes.

The lower guide rail 60 may also be moved inwardly and outwardly with respect to the inner rail 24 and/or outer rail 26. For example, in a preferred embodiment of the invention, the lower guide rail 60 may be movable with the intermediate member 28 so that it is essentially centered between the guide rails 24 and 26 (see FIG. 4). As shown in FIG. 5, the lower guide rail 60 is fixed to a support rail 62 but free to move laterally therewith on the cross rods 63 and 64.

The lower guide rail 60 is adjustable vertically in an upward or downward direction by conventional means such as a plurality of rods and clamps which are specifically adjustable by a mechanic during a set up or change over. The vertical adjustment may also be accomplished by an automated mechanism which is essentially identical to the side rail adjustment mechanism. For example, a vertically oriented gear driven mechanism can be used to adjust the lower rail simultaneously at a plurality of points along its length.

The lower rail 60 is moved up or down so that the top of a carton is at a fixed height with respect to the intermediate guide member 28. In other words, the plane of the top of a carton forms a reference point for adjustments to the lower rail 60.

Figure 6:
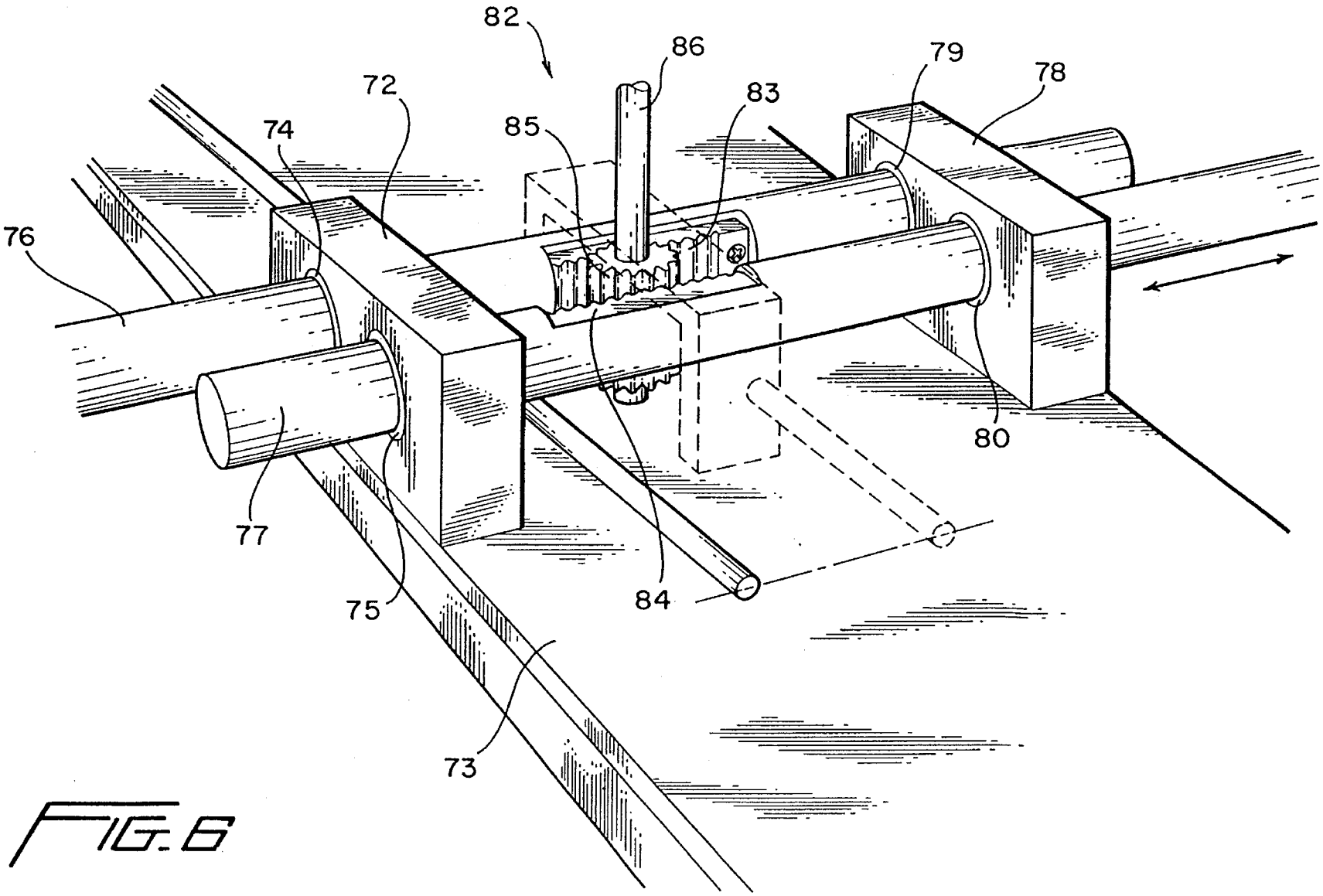
FIG. 6 is a perspective view of an adjustment mechanism for use in one embodiment of the present invention.

FIG. 6 illustrates a rail adjustment mechanism in accordance with one embodiment of the invention. For example, a mounting block 72 is fixed to a frame or base 73 and includes two parallel cylindrical sleeves 74 and 75 passing therethrough. A pair of cylindrical rods 76 and 77 pass through the sleeves 74 and 75 with the rod 77 fixed to the block 72 while the second of the rods 76 is in sliding engagement with the bushing or sleeve 74.

A second mounting block 78 is fixed to the outer guide rail 26. This block 78 also includes a pair of parallel cylindrical sleeves 79 and 80 which are axially aligned with sleeves 74 and 75. The rods 76 and 77 pass through the sleeves 79 and 80 with the rod 76 fixed to block 78. In other words, the rod 76 does not move with respect to block 78 while the rod 77 is in sliding engagement with sleeve 80.

A rack and pinion assembly 82 comprises a pair of racks 83 and 84 which are formed in rods 76 and 77 and constructed and arranged to face one another. A pinion 85 is disposed between and engages each of the rods 83 and 84. Rotation of the pinion 85 moves the rods 76 and 77 toward or away from one another in response to the rotation of a shaft 86. Since the rod 77 is fixed to the block 72 and rod 76 to block 78, the distance moved by rail 26 is twice the distance moved by either one of the racks. Therefore, the use of a single rack with an identical pinion operatively connected to the intermediate guide member 28 will move the guide rail 28 one half of the distance moved by the outer guide rail 26. For this reason, the member 28 will be centered between rails 24 and 26.

A trailing comer of the carton 11 is also fixed as a reference point by means of a trailing lug **12*a* (FIG. 1) in the adjustable pocket mechanism 12. Since the distance between trailing lugs 12*a* is fixed by the chain 13 and trailing lug 12*a*, the top upper back comer becomes the reference point for all adjustments to the apparatus 10** in order to accommodate cartons of different sizes.

The invention also contemplates an adjustable pocket means in combination with the means for establishing the upper, back trailing comer as the reference for all adjustments. Any suitable adjustable pocket may be used as will be well understood by a person of ordinary skill in the art. Nevertheless, it is presently believed that an adjustable pocket mechanism in accordance with my aforementioned copending application is particularly suitable for this application.

As disclosed therein, the adjustable pocket mechanism or member 12 includes a pair of parallel endless chains 13, 21 (see FIG. 2) which are disposed one above the other around sprockets 14 and 15. The mechanism also includes a pair of lugs **12*a* and 12*b* (FIG. 1). A first of the lugs 12*a* referred to as a leading transport lug is fixed to a first or top of the endless chain 13 and at the same time slidably engages a lower of the endless chains 21. In other words, the leading lug 12*b* is free to move forwardly or rearwardly with respect to the lower chain 21. A second of the lugs 12*a* or trailing lug is then fixed to the second or lower chain 21 and slidably engages the first or upper chain 13 so that it is freely movable forwardly and rearwardly with respect to the first of the chains 13**.

Means such as a clutch mechanism 8 are provided for adjusting the chains relative to one another and for fixing the relative position of the sprockets and/or chains. In essence, the simple clutch mechanism 8 may be used to lock the upper sprocket 14 and lower sprocket 15 together. In this way, a simple drive mechanism such as the shaft 8' driven by a motor 9 rotates the upper sprocket 14. Since the upper sprocket 14 is in locked engagement with the lower sprocket 15, the two endless chains 13 and 21 are moved about the sprockets at the same speed and in the same relative position. Then, when it is desired to adjust the length of the pocket, the clutch is disengaged so that the upper sprocket moves forward or rearwardly with respect to the lower sprocket to thereby change the length of the pocket in order to accommodate cartons of different widths. The means for adjusting the relative position of the sprockets and chains may take the form shown in U.S. Pat. No. 4,718,540, entitled "Automatic Change Over for a Cartoner", which is incorporated herein in its entirety by reference. However, as presently envisioned, a more simplified arrangement may be used.

It is also contemplated that the relative position of the upper and lower chains 13 and 21 can be adjusted manually by means of a knob 41. The knob 41 moves a driving element 43 and drive member 44 to position the sprocket 14 with respect to sprocket 21 in a conventional manner. It is also contemplated that such adjustments can be accomplished by means of a computer 45 and input 46.

While the invention has been described in connection with its preferred embodiments, it should be recognized that changes and modifications may be made without departing from the scope of the appended claims.

What is claimed is:

1. A carton conveyor and loading apparatus in which cartons are vertically oriented and upwardly open when loading and in which cartons are transported from receiving station to a filling station and to a carton discharge station comprising:

means defining an endless pathway in a generally horizontal plane;

an endless carton conveyor for transporting cartons from a first location to a second location and back toward the first location:

a first and a second generally horizontal longitudinally extending parallel guide members for fixing the position of carton as it is transported along a portion of said pathway with said first of said guide members fixed in position with respect to said pathway and with said second of said guide members adjustable inwardly and outwardly with respect to said first guide member for accommodating cartons of different thicknesses;

an intermediate member essentially equally spaced from said first and said second guide rails and carton finishing apparatus disposed on said intermediate members; and means for simultaneously moving said intermediate member and said second of said guide rails laterally with respect to said first guide rail so that the distance moved by said intermediate member is one half of the distance moved by said second of said guide rails.

2. A carton conveyor and loading apparatus according to claim 1 in which said means for moving said intermediate members and said second of said guide rails includes a plurality of gears.

3. A carton conveyor and loading apparatus according to claim 2 which includes a pair of mounting blocks and a pair of parallel sleeves in each of said blocks and in which the sleeves in a first of said blocks are axially aligned with the sleeves in a second of said blocks and with said first of said blocks fixed to a first of said guide rails and said second of said blocks fixed to a second of said guide rails and which includes a pair of parallel rods passing through said sleeve with one of said rods fixed to a first of said blocks and in sliding engagement with said second of said blocks and wherein the second of said rods is fixed to said second of said blocks and in sliding engagement with one of said sleeves in said second of said blocks.

4. A carton conveyor and loading apparatus according to claim 3 in which said means for moving said intermediate member and said second of said guide rails include a worm gear and a ball follower driven by said worm gear.

5. A carton conveyor and loading apparatus according to claim 3 in which said means for moving said intermediate members and said second of said guide rails include a rack and pinion.

6. A carton conveyor and loading apparatus according to claim 3 which includes a keyed shaft with a first gear fixed at one end of said shaft, and a second gear in sliding engagement with said shaft for longitudinal movement along said shaft and for rotation by said shaft.

7. A carton conveyor and loading apparatus according to claim 3 in which said sleeves and said rods have a circular cross section.

8. A carton conveyor and loading apparatus according to claim 3 which includes a lower guide rail and means for adjusting said lower guide rail vertically to accommodate cartons of different heights.

9. A carton conveyor and loading apparatus according to claim 8 which includes means defining a pocket and means for adjusting said pocket to accommodate cartons of different widths.

* * * * *